United States Patent [19]

Lewis

[11] Patent Number: 4,518,199

[45] Date of Patent: May 21, 1985

[54] CONTOUR SEAT MODULE

[75] Inventor: Robert E. Lewis, Urbana, Ill.

[73] Assignee: American Seating Company, Grand Rapids, Mich.

[21] Appl. No.: 339,904

[22] Filed: Jan. 18, 1982

[51] Int. Cl.[3] ..... E04H 3/12; A47C 15/00

[52] U.S. Cl. ..... 297/248; 297/DIG. 2

[58] Field of Search ..... 297/248, DIG. 2, 232; 52/8

[56] References Cited

U.S. PATENT DOCUMENTS

| | | | |
|---|---|---|---|
| 2,433,012 | 12/1947 | Zalicovitz | 297/DIG. 2 |
| 2,817,389 | 12/1957 | Richards | 52/8 |
| 3,222,698 | 12/1965 | Levenson | 297/DIG. 2 |
| 3,531,157 | 9/1970 | Duckett et al. | 297/248 |
| 3,667,171 | 6/1972 | McClelland . | |
| 3,700,279 | 10/1972 | Reineman et al. | 297/DIG. 2 |
| 3,702,204 | 11/1972 | Tipton et al. | 297/248 |
| 3,784,251 | 1/1974 | Persson et al. | 297/248 |
| 4,000,586 | 1/1977 | Vance . | |
| 4,155,202 | 5/1979 | Hartman . | |
| 4,244,621 | 1/1981 | Lazaroff et al. | 297/248 |
| 4,307,914 | 12/1981 | Grandclement | 52/8 X |
| 4,409,762 | 10/1983 | Raymond . | |
| 4,438,603 | 3/1984 | Durkan, Jr. | 52/8 |

*Primary Examiner*—Francis K. Zugel

*Attorney, Agent, or Firm*—Emrich & Dithmar

[57] ABSTRACT

A seat module having full perimeter structural interlocking end portions for coupling adjacent modules together when they are assembled and which is particularly adapted for use in a tiered structure, e.g., folding bleachers, is disclosed. The seat module includes a contoured, upper seating surface for an occupant of the seat, an inwardly curved rear surface for increased foot room for an occupant of the next higher row, and a sloped front surface for full leg movement. The individual modules are molded from a single piece of high impact resistant, structural foam and include a single internal load transfer member extending from top to bottom in dividing the interior thereof into two separate chambers and increasing module stability and strength. The lower portion of the seat module is adapted to be mounted by means of a single hardware fitting in the lengthwise slot of an extruded nose beam which is firmly mounted to the seating platform structure. Seat module mounting hardware is internal to the module and thus concealed after installation. This improves appearance and reduces damage through vandalism. Each end of a row of assembled seat modules is provided with a structural foam enclosure for concealing seat module internal structure and hardware fittings in providing a finished appearance.

27 Claims, 5 Drawing Figures

CONTOUR SEAT MODULE

BACKGROUND OF THE INVENTION

This invention relates generally to an arrangement of seats for use in a stadium, auditorium, etc., and is particularly directed toward a contour seat module adapted to be positioned on and securely coupled to a tiered seating structure.

Telescoping bleacher systems which extend for use and are retracted for storage have been available for nearly fifty years. This type of seating arrangement is typically used in an auditorium or gymnasium and allows for making floor space available for other purposes when the seating is not in use. These seating systems (sometimes referred to as a chair platform) generally provide a bench-type seating arrangement or individual folding seats for spectator viewing. The present invention is useful in all such systems and, as persons skilled in the art will readily appreciate, it has other, more general uses as well, such as in fixed riser seating, e.g., concrete tiers.

In a folding bleacher type of seating arrangement, it is desirable that the seats possess high strength and high impact resistance while offering a comfortable, stable seating surface. In addition, the seats should be light in weight for ease in installation and removal and for facilitating retraction and extension of the entire tiered seating structure. Furthermore, it is desirable that seat mounting hardware be concealed and easily attached to and detached from the seat support structure. Further, seat mounting procedures and equipment should provide for accurate seat alignment while eliminating gaps between adjacent seats for aesthetic as well as functional reasons. Seat configuration and associated mounting hardware should also be such as to facilitate, rather than interfere with, the sweeping and cleaning of the seat support structure. Finally, the seats should be wear-resistant and maintenance-free particularly in an outdoor environment and thus not susceptible to rusting, splitting, warping or vandalism.

The present invention is directed toward a contour seat module which provides all of the aforementioned advantages and is also readily adapted for low cost, mass production fabrication techniques.

SUMMARY OF THE INVENTION

The present invention includes a unitary seat module made of high impact resistant, structural foam which is adapted for full perimeter, end structure interlocking in forming adjacent, tiered seating arrangements such as for stadium, auditorium, or gymnasium use. The unitary seat module includes a contoured, upper seating surface, a sloped front surface for full leg movement of the occupant and an inwardly curved rear surface for unencumbered rear foot room. A generally vertically oriented internal load transfer member provides structural reinforcement and seat stability by reducing any tendency of the seat to "rock" as the occupant shifts his weight fore and aft. A lower portion of the seat module is adapted to be firmly affixed by means of a single mounting mechanism located within the module to a horizontally oriented extruded nose beam which is integrated with the tiered seating platform. Each end of a row of seat modules is provided with a structural foam enclosure for concealing the end module mounting mechanism and for providing a finished appearance.

The concealed mounting mechanism includes a bolt-adjusted bracket accessible from either of the open sides of the module for engaging the nose beam. An internal portion of the lower surface of the seat module is bolted directly in a slot on the upper surface of the nose beam with the bolt holding a clamp which locks an adjacent module into place when assembled to the first module. An angled lead-in member is inserted in a slot running the length of the nose beam causing a lateral surface of the nose beam to securely engage an adjacent surface of the lower portion of the seat module for rigidly coupling the module to the nose beam throughout substantially the entire length of the module. Seat module installation and removal is thus facilitated and seating row structural integrity enhanced.

BRIEF DESCRIPTION OF THE DRAWINGS

The appended claims set forth those novel features believed characteristic of the invention. However, the invention itself as well as further objects and advantages thereof will best be understood by reference to the following detailed description of a preferred embodiment taken in conjunction with accompanying drawings, where like reference characters identify like elements in the several figures, in which:

DESCRIPTION OF THE PREFERRED EMBODIMENT

Figure 1:
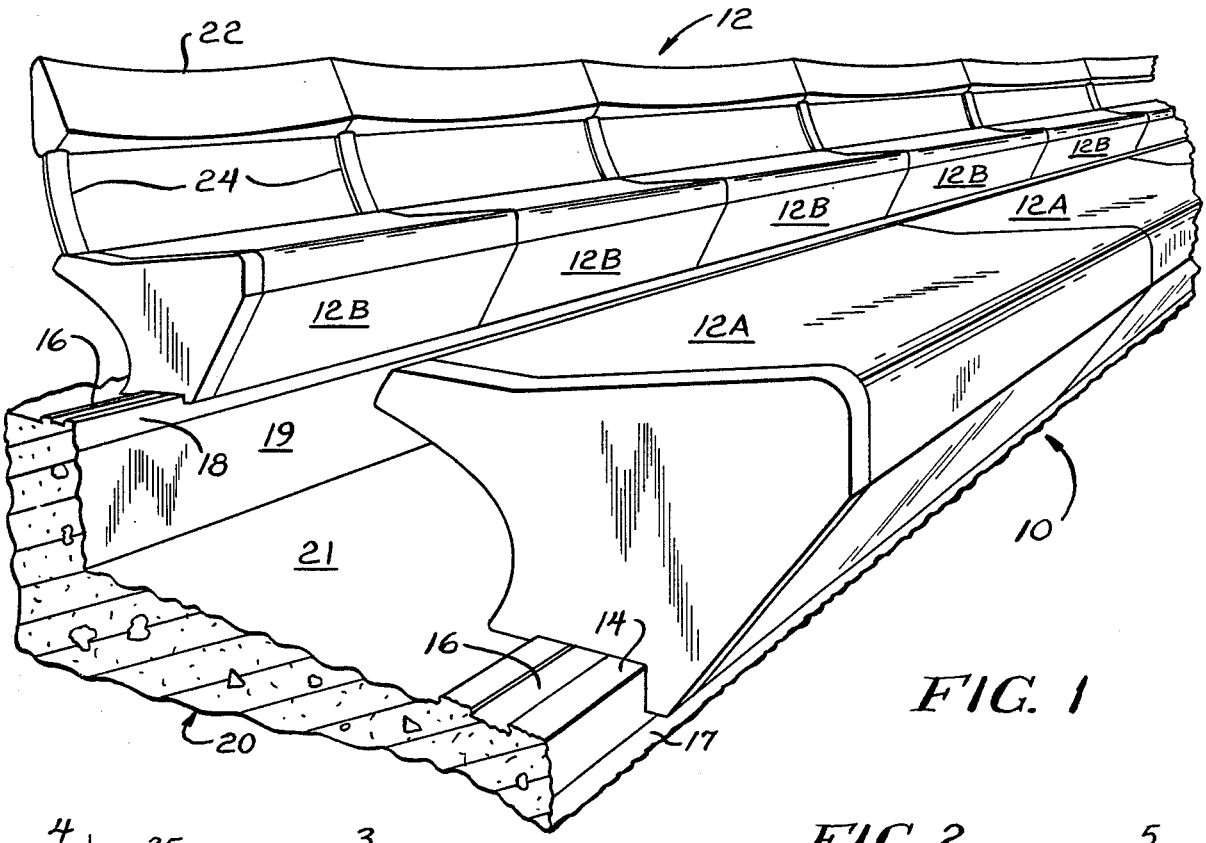
FIG. 1 is a fragmentary upper perspective view of two rows comprised of a plurality of coupled contour seat modules in accordance with the present invention, in which the contour seat modules are arranged in a linear fashion.

Referring to FIG. 1, there is shown first and second rows 10, 12 of coupled contour seat modules in accordance with a preferred embodiment of the present invention. Each row is comprised of a deck 20 and an understructure (not shown). A deck 20 includes a riser section 19, a tread portion 21, and a row of seats such as rows 10 and 12. As shown in FIG. 1, rows 10 and 12 each include a plurality of individual contour seat modules 12A and 12B, respectively, each coupled to adjacent, identical modules to form linear arrays of seating surfaces. The contour seat modules of the present invention are particularly adapted for mounting on a tiered platform as shown in FIG. 1 which includes a plurality of parallel mounting beams 14, 18, rigidly mounted on the tread portion 21 of deck 20. Mounting beams 14, 18 are typically comprised of a high strength metal and include a slot 16 located in an upper surface and running the length thereof. Each mounting beam 14, 18 is mounted adjacent the forward, generally vertical riser section 17, 19 of each tiered platform. Thus, referring to FIG. 1, the legs of a person sitting on a contour seat module in the second row 12 would be positioned immediately in front of riser section 19 with his or her feet positioned so as to rest on tread section 21.

Mounting beams 14, 18 each include a slot 16, as shown in FIG. 1, into which a mounting assembly (not shown) is inserted for the fixed mounting of the contour seat modules thereupon. The manner in which individual seat modules are positioned upon mounting beams 14, 18 is described in detail below. Also shown in FIG. 1 with respect to the second, or rear, row of contour seat modules 12 are a plurality of back panels 22, each coupled by means of a pair of back panel supports 24 to a rear, upper portion of each contour seat module 12B in that row.

Figure 2:
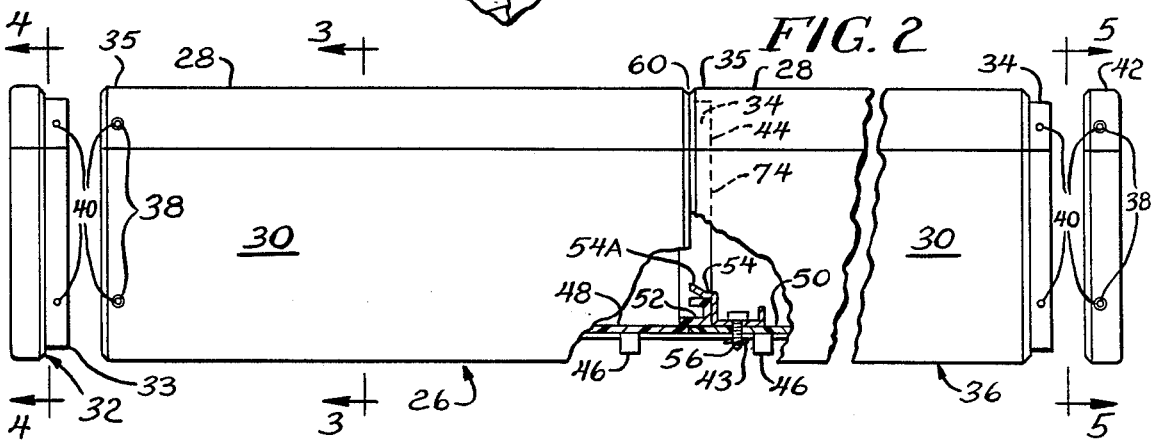
FIG. 2 is a partially cut away front view of two assembled contour seat modules constructed according to the present invention.

Referring to FIG. 2, there is shown a partially cut away front view of first and second contour seat modules 26, 36 in accordance with a preferred embodiment of the present invention. Each contour seat module 26, 36 includes a front, or riser, panel or wall 30 and an upper seating panel 28. Each contour seat module 26, 36 also includes an open receptacle end portion 35 and an insert housing 34 at the opposite end thereof. The open receptacle end portion 35 of the contour seat module is adapted to receive either the insert housing 33 of a male end cap 32 or the insert housing 34 of an adjacent contour seat module, such as seat module 26 with respect to seat module 36. Each insert housing fits tightly within the corresponding open receptacle end portion 35 of the ajacent contour seat module and is fastened therein by means of connecting pins 38 inserted through holes 40 therein. As shown in FIG. 2, male end cap 32 is mounted on the open receptacle end portion 35 of contour seat module 26 which is positioned on an end of a row of similar seat modules. The other end of end seat module 26, or the insert housing 34 thereof, is, in turn, coupled to the open receptacle end portion 35 of immediately adjacent contour seat module 36.

To the other end of contour seat module 36, which also includes an insert housing 34, is coupled female end cap 42. Female end cap 42 is positioned in full contact with the entire perimeter of insert housing 34 and is fastened thereto by means of connecting pins 38 inserted through holes 40 in insert housing 34 and female end cap 42. Thus, from FIG. 2 it can be seen that immediately adjacent contour seat modules positioned on a mounting structure such as mounting beams 14 or 18 are intimately linked together by means of respective, complementing insert housings 34 and open receptacle ends 35 to form a continuous, generally linear seating surface comprised of the upper panels 28 of individual linked contour seat modules. In addition, the end portions of a linear arrangement of contour seat modules are enclosed by means of either a male or female end cap 32, 42, depending upon whether the outer portion of the end contour seat module has either an open receptacle end portion 35 or an insert housing 34 associated therewith. By thus capping the end portions of a row of contour seat modules, the seating arrangement of the present invention is provided with a finished appearance, the seating area is more easily cleaned and swept, and the internal structure and end mounting fixtures of the end seat modules are concealed and inaccessible to those using the seating arrangement of the present invention.

The manner in which adjacent contour seat modules are mutually coupled during installation is shown in FIG. 2. Each contour seat module 26, 36 includes a respective lower panel, or base, 48, 50. One end portion of a contour seat module lower panel includes a mounting extension depicted by element 52 with respect to lower panel 48 in FIG. 2. Mounting extension 52 extends laterally and upward from lower surface 48 and is a rigid extension of that lower panel. The immediately adjacent portion of adjoining lower panel 50 includes an aperture through which a connecting pin, or bolt, 56 may be inserted for fixedly positioning mounting bracket 54 thereon. Mounting bracket 54 also includes an aperture through which connecting pin 56 is inserted in coupling bracket 54 to an upper portion of lower surface 50. Mounting extension 52 is slidably engaged by mounting bracket 54 when adjacent contour seat modules are installed on a support structure. Mounting bracket 54 includes a lead-in portion 54A on the distal end thereof for facilitating the sliding engagement of mounting extension 52 and mounting bracket 54 positioned on the lower surface 50 of second contour seat module 36. With the mounting extension 52 of lower surface 48 engaged by mounting bracket 54 as shown in FIG. 2, the tightening of connecting pin 56 results in the rigid mounting of adjacent contour seat modules 26, 36 to the mounting structures to which connecting pin 56 is coupled. The combination of mounting extension 52 and mounting bracket 54 also permits stress arising from the tightening of connecting pin 56 to be spread out over a larger area of lower panel 48 in reducing the possibility of stress cracks occurring in this portion of a contour seat module. Connecting pin 56 may either be directly coupled to the mounting beam or may be fastened thereto by means of a mounting bracket 43. Mounted on the lower panel of each contour seat module is a mounting insert 46 described in the next paragraph.

Figure 3:
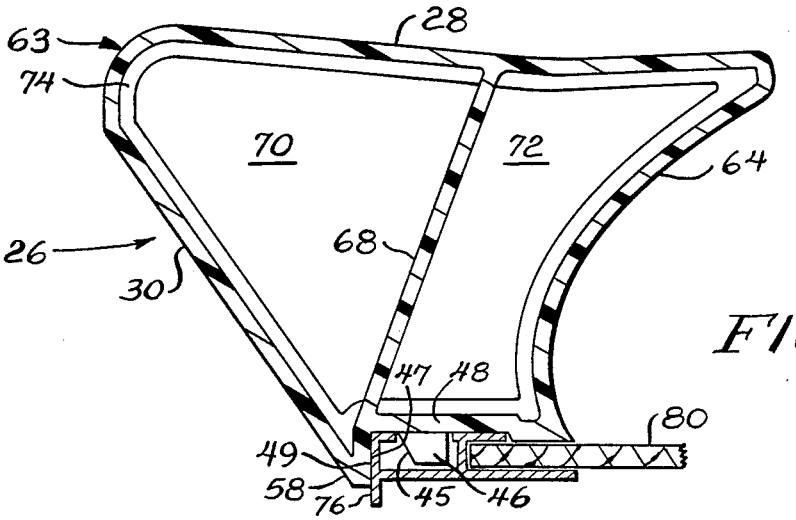
FIG. 3 is a vertical cross sectional view taken through the sight line 3—3 of FIG. 2.

Referring to FIG. 3, there is shown a vertical cross sectional view of a contour seat module 26 in accordance with the present invention taken through the sight line 3—3 of FIG. 2. Contour seat module 26 includes a lower panel 48 to which is fixedly connected a mounting insert 46, which in a preferred embodiment extends only over a portion of the length of a seat module but could as well extend over its entire length. Mounting insert 46 is positioned in the lengthwise slot of a mounting beam 76, which in a preferred embodiment of the present invention is an extruded aluminum nose beam. An end portion of tread section 80 is encapsulated with extruded nose beam 76. Mounting insert 46, which extends essentially the entire length of seat module 26, includes an angled, lead-in surface 45. Lead-in surface 45 facilitates the positioning of mounting insert 46 in the longitudinal slot of mounting beam 76. With mounting insert 46 positioned within the slot of mounting beam 76, a first facing surface 47 on the forward portion of mounting beam 76 is positioned immediately adjacent and in facing relation to a second facing surface 49 on a lower, vertical portion of contour seat module 26. The facing, abutting relationship between surfaces 47, 49 enhances contour seat module positioning stability on beam 76 by reducing the tendency of the seat to "rock" as the occupant shifts his weight fore and aft, while facilitating the installation of the contour seat module on the mounting beam. In addition, mounting insert 46 when installed in the slot of the mounting beam 76 insures proper alignment between the mounting extension 52 and mounting bracket 54 of adjacent contour seat modules, previously described with respect to FIG. 2. Finally, it is to be noted that curved rear panel 64 also substantially enhances seat stability by the contact made between its lower edge which extends the length of an individual seat module and tread section 80. This line of supporting contact between rear panel 64 and tread section 80 further extends over the entire row of assembled contour seat modules for enhanced row stability.

As shown in FIG. 3, contour seat module 26 includes a contoured upper seating panel 28 which forms an acute angle with a curved, sloped rear panel, or wall, 64. The forward portion of upper panel 28 is coupled to a front panel or wall, 30 by means of a nose portion 63. The downward extension of front panel, or riser section, 30 forms a lower projection 58 which includes a second facing surface 49 previously described. Lower projection 58 is connected to rear panel 64 by means of a lower surface, or base, 48 of contour seat module 26. Coupled to an upper, forward portion of lower panel 48 is a web, or support element, 68 which extends upward to and is integrally coupled with upper panel 28. Web 68 runs the entire length of the contour seat module, with its compression opposing the forward "rocking" of the seat module and its extension opposing the rearward "rocking" of the seat module.

While the description of the contour seat module 26 provided in the previous paragraph includes reference to individual elements, or portions, thereof, the contour seat module of the present invention is comprised of a unitary structure of high strength structural foam. Thus, contour seat module 26 includes forward and rear chambers 70, 72 separated by web 68. Chambers 70, 72 run the length of contour seat module 26, with web 68 increasing the strength and rigidity of the contour seat module by equalizing the torsional moments about mounting beam 76 in directing the weight of a person sitting on the seat module directly through mounting beam 76.

The legs of a person sitting on contour seat module 26 as shown in FIG. 3 would extend forward of nose portion 63 with his or her feet positioned forward and below riser section 30 so as to rest upon a second horizontal platform (not shown). The angled orientation of riser section 30 with respect to upper panel 28 allows for full leg movement. Similarly, curved rear panel 64 is convex with respect to riser section 30 thus providing for unencumbered rear foot room for one sitting on a contour seat module immediately to the rear of contour seat module 26. Located immediately interior to and around the entire circumference of the outer, unitary structure of contour seat module 26 is a full perimeter structural interlock 74 described below.

The full perimeter structural interlock 74 of the contour seat module of the present invention can be explained with reference to FIG. 2. In FIG. 2 is shown an insert housing 34 integrally coupled to an end portion of the first contour seat module 26. When the seat modules are installed, insert housing 34 is positioned within the open receptacle end portion 35 of an adjacent contour seat module 36. Insert housing 34 is located interior to and in contact with the entire outer surface of seat module 26 and includes the full perimeter structural interlock 74 shown in FIG. 3. The open receptacle end portion 35 of contour seat module 36 includes a recessed portion into which insert housing 34 is positioned. Open receptacle end portion 35 includes a surface 44 defining the recessed portion thereof which abuts full perimeter structural interlock 74 when adjacent contour seat modules are installed. Similarly, facing perimeter end surfaces on contour seat modules 26, 36 abut each other along joint 60 when the contour seat modules are installed. Joint 60 is of a shallow V-groove design for insuring seating surface continuity and smoothness. Full perimeter structural interlock 74 and associated insert housing 34 cooperate with the adjacent recessed portion of the open receptacle end portion 35 to prevent adjacent sections from breaking apart due to high impact forces applied along joint 60 and enhance the structural rigidity and integrity of the linear arrangement of identical contour seat modules.

Figure 4:
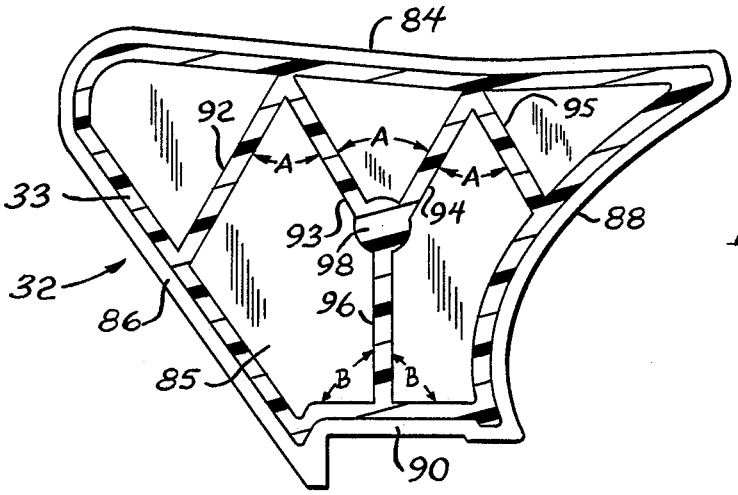
FIG. 4 is an interior side view of a male end cap adapted for secure attachment to the outside portion of one end contour seat module in a row of such modules.

Referring to FIG. 4, there is shown an interior side view of a male end cap 32 briefly described earlier with reference to FIG. 2. Male end cap 32 includes an upper panel 84, a lateral panel 85, a front panel 86, a rear panel 88, and a lower panel 90. These surfaces define the outer structure of male end cap 32. Interior to and abutting the outer structure of male end cap 32 is insert housing 33 around the perimeter thereof. As shown in FIG. 2, insert housing 33 is positioned within the open receptacle end portion 35 of contour seat module 26 to seal off the end of a row of contour seat modules and provide a finished appearance.

Extending outward from male end cap 32 and integral with its insert housing 33 is an internal reinforcing structure comprised of support ribs 92, 93, 94, 95 and 96. Support rib 92 is coupled between the front and upper panels 86, 84 of male end cap 32. Support rib 95 is coupled between the upper and rear panels 84, 88 of male end cap 32. Support ribs 93, 94 which are coupled to upper panel 84 are connected to support rib 96 by means of internal support junction 98. Internal support rib 96 is perpendicular to lower panel 90 with angle $B=90°$. Similarly, support ribs 92 and 93, 93 and 94, and 94 and 95 all form equal angles therebetween. This angle is indicated as A in FIG. 4. Thus, the outer structural shell of male end cap 34 is reinforced and made rigid by the orientation and configuration of the aforementioned internal support ribs.

Figure 5:
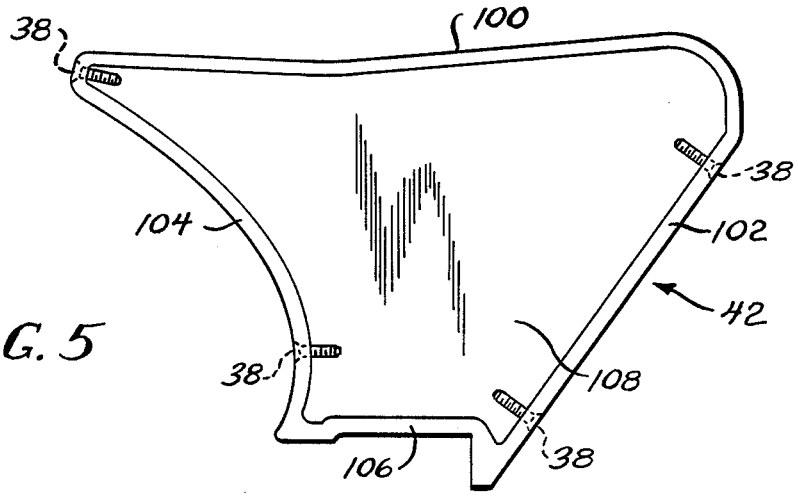
FIG. 5 is an interior side view of a female end cap adapted to be securely attached to the outside portion of a contour seat module located on the other end of a row of such modules.

Referring to FIG. 5 there is shown a female end cap 42 which includes an upper panel 100, a front panel 102, a rear panel 104, a lower panel 106, and a lateral panel 108. Lateral panel 108 encloses an end of a contour seat module when female end cap 42 is positioned thereon. Included in the various surfaces of female end cap 42 are a plurality of apertures through which connecting pins 38 are inserted for rigidly coupling female end cap 42 to the insert housing 34 of an adjacent contour seat module 36 as shown in FIG. 2. In a preferred embodiment, connecting pins 38 are counter sunk plastic drive rivets. These same counter sunk plastic drive rivets 38 are inserted in apertures 40 in the receptacle end portion 35 of a contour seat module and in the insert housing 33 of a male end cap 32 as shown in FIG. 2. Thus, both male and female end caps are coupled in a similar manner to the end portions of a contour seat module.

There has thus been shown a unitary contour seat module integrally molded from foam plastic. Individual contour seat modules are adapted to be rigidly coupled to an upper surface of a support member and to be connected end-to-end by means of full perimeter, end structure interlocking in forming a linear seating arrangement of adjacent contour seat modules. The unitary seat module includes a contoured, upper seating panel, an inwardly curved rear panel for unencumbered rear foot room, a sloped front panel for full leg movement and a generally vertically oriented internal web member providing structural reinforcement and seat stability. Individual seat modules are coupled to the support member by means of a single mechanical coupling which is located interior to the seat module and is concealed by means of fixedly mounted row end caps.

While particular embodiments of the present invention have been shown and described, it will be apparent to those skilled in the art that changes and modifications may be made therein without departing from the invention in its broader aspects. The aim of the appended claims, therefore, is to cover all such changes and modifications as fall within the true spirit and scope of the invention.

I claim:

1. A plurality of separate seat modules arranged in adjacent contacting relation in a linear seating arrangement above the riser of a tiered seating structure, each seat module fixedly mounted on a rigid support member and comprising: an integral molded body having an upper seating panel contoured only in a fore-to-aft direction to support a person sitting thereon, a front panel extending downward from said seating panel, a rear panel extending downward and forwardly of said upper panel, a base extending between the lower portions of said front and rear panels, each seat module further including two end portions, with each of said end portions including interlocking structure positioned on the perimeter thereof for interconnecting adjacent seat modules mounted on said rigid, support member; integral structural support wall means for increasing the load bearing capacity of said module; and mounting means assembled to said base from the top and within each seat for fixedly mounting said seat module on said rigid support member; the interior of said seats being generally hollow and said seat panel located above said base a substantial distance sufficient to provide access to said mounting means, said seats characterized in that when a plurality of said seats are assembled in side-by-side relation, top seating surfaces of adjacent seats form a substantially continuous bench-like seating surface.

2. A seat structure as set forth in claim 1 wherein said rigid support member comprises a metal base with said mounting means including a detachable clamp for rigidly attaching each seat module to said beam.

3. A seat structure as set forth in claim 2 wherein said clamp is adapted for engaging and aligning an immediately adjacent seat module positioned on said rigid support member for facilitating the installation and increasing the stability of said seat modules when assembled together.

4. A seat structure as set forth in claim 1 wherein each module is comprised of structural foam molded into a single body.

5. A seat structure as set forth in claim 4 further including end cover means adapted for securely engaging an end portion of said seat module not connected to an adjacent seat module in providing an enclosure therefor.

6. A seat structure as set forth in claim 5 wherein said mounting means is coupled to said base within said seat module, with respective mounting means concealed in each of said seat modules, said end cover means being positioned on the respective end portions of the end seat modules in said linear arrangement.

7. A seat structure as set forth in claim 1 wherein the base of said seat module and said rigid support member include respective first and second surfaces with the first and second surfaces of said base aligned with and engaging the respective first and second surfaces of said rigid support member for increased seat module stability.

8. A seat structure as set forth in claim 7 wherein said respective first surfaces are oriented generally horizontally and said respective second surfaces are oriented generally vertically when said seat module is fixedly positioned on said rigid support member.

9. A seat structure as set forth in claim 8 wherein said rigid support member comprises a metal beam including a slot in an upper surface thereof and extending the length of said rigid support member, and wherein the base of said seat module includes an angled projection thereon for forcing said respective second surfaces of said base and said metal beam into engaging contact when said angled projection is inserted into said slot.

10. A seat structure as set forth in claim 1 further including back support means fixedly mounted to a rear portion of said seat module and extending upward from the upper seating panel thereof.

11. A seat structure as set forth in claim 1 further comprising a structural support wall extending between said base and said seat panel, said support wall being under tension when a rearward force is exerted upon said seat module and under compression when a frontward force is exerted thereupon for increasing the stability of a mounted seat module.

12. A seat structure as set forth in claim 1 wherein said structural support wall means comprises a wall extending from said seat panel downwardly and forwardly to said seat base, whereby at least some of the the weight of a person sitting upon said upper seating panel is transmitted directly to said rigid support member by means of said structural support wall in equalizing the torsional moments about said rigid support member for increased seat module stability.

13. A seat structure as set forth in claim 13 wherein said support wall terminates short of one end of said module whereby said one end of said module defines an end recess bordered by said seating panel, front and rear panels and said base; and wherein the other end of said module defines an integrally molded extension dimensioned to be snugly received in the end recess of an adjacent module when said modules are assembled together and to said rigid support member.

14. In a seating structure comprising a plurality of tiers each having a riser and a tread, the combination of a rigid mounting support structure extending along each tread adjacent the forward portion thereof and a plurality of seating modules, each module coupled to an adjacent module and to said mounting support structure, each module further comprising an integrally molded body member having an upper seating panel contoured to support a person sitting thereon, a front panel extending downward from said seating surface and sloped rearwardly at least over a major portion thereof, a rear panel extending downward and forwardly of said upper surface, a base extending between the lower portions of said front and rear panels, and a structural wall located within said seat module and extending between said seating panel and said base, and mounting means coupled to said base for fixedly positioning said seat module on said rigid support member, wherein said support wall terminates short of one end of said module whereby said one end of said module defines an end recess bordered by said seating panel, front and rear panels and said base, and wherein the other end of said module defines an integrally molded extension dimensioned to be snugly received in the end recess of an adjacent module when said modules are assembled together and to said rigid support member.

15. A seating structure for use on a tiered understructure, each tier having a horizontal tread surface and a vertical riser surface depending from said tread surface, said seating structure comprising a plurality of unitary seat modules each adapted to receive a person sitting thereupon and including means for securely mounting said seat module upon said understructure, each of said seat modules including a seat panel defining an upper seating surface forming an extension of the seating surface of adjacent modules and molded structural plastic support structure for supporting said seat panel above the tread of an associated tier, said plastic support structure including a base and substantially continuous front and rear panels extending laterally the width of a module and adapted to engage the associated edges of the corresponding panels of adjacent modules without crevices, said seat modules including interlocking structure extending behind and laterally of at least the front panel of a module and adapted to extend behind the front panel of an adjacent seat module substantially the entire height of said front panel to provide substantially continuous seating surface and substantially crevice-free front and rear panels extending the length of said coupled seat modules.

16. A seating structure as in claim 14 wherein said coupling means further includes bracket means located within and on a lower portion of each seat module for fixedly engaging an adjacent seat module and for securely mounting said seat module on said support member.

17. A seating structure as in claim 16 wherein said support member comprises a metal beam including an aperture therein for securely coupling said bracket means thereto.

18. A seating structure as in claim 17 further comprising end cover means adapted for securely engaging an outer end portion of each seat module positioned at each end of said continuous seating surface.

19. A seating structure as in claim 18 wherein said end cover means is securely positioned on the outer coupling means of the seat modules positioned at each end of said continuous seating surface.

20. A seating structure as in claim 17 wherein said seat modules are comprised of structural foam molded into a single body.

21. In a seating structure comprising a plurality of tiers each having a riser and a tread, the combination of a rigid mounting support structure extending along each tread adjacent the forward portion thereof and a plurality of seating modules adjacent each other in a lineal seating arrangement, each module having an upper seating panel for supporting a person sitting thereon such that the occupant's feet rest on the tread of the next lower tier, a front panel extending downward from said seating panel, a rear panel extending downward from said upper seating panel and forwardly, and a base extending between the lower portions of said front and rear panels, at least said front panel, rear panel and base being integrally formed of structural foamed plastic, at least said front panel and rear panels forming substantially continuous extensions of one another when adjacent modules are in assembled relation, and bearing at least some of the load on said seating panel to said base; mounting means for fixedly attaching the bases of adjacent seat modules together and to said rigid support member, interconnecting means extending vertically along at least the major part of said front and rear panels and to one side thereof and located immediately inwardly of said respective panels and dimensioned to be snugly received in a corresponding recess of an adjacent module when said modules are assembled together and to said rigid support member.

22. The apparatus of claim 21 wherein said rear panel of each seat module has a lower horizontal edge cooperating with and engaging the associated tread of said seating structure to stabilize said module when assembled to said structure and to avoid dirt-gathering crevices between said tread and said module.

23. The apparatus of claim 22 wherein said rigid mounting support structure comprises a metal nose beam in said seating structure at the front of said tread and defining an upper horizontal surface and a forward vertical surface; and wherein said module is formed such that said front panel extends below the upper horizontal surface of said nose beam to continuously engage both the forward surface of said nose beam with the rear of said front panel extension and the upper surface of said nose beam with the base of said module to stabilize said module when assembled to said structure.

24. The apparatus of claim 23 wherein said mounting means attaches the base of said module to said nose beam of said structure and is characterized as being applied from within said module and hidden from view after installation.

25. The apparatus of claim 24 further comprising first and second end caps for closing the outboard ends of the two outermost modules respectively in said lineal arrangement whereby adjacent modules are interlockingly engaged with mounting means within said modules and substantially free of crevices.

26. The apparatus of claim 21 wherein each module further comprises an upright wall extending from said base to strengthen said module under use loading conditions.

27. In a seating structure comprising a plurality of tiers each having a riser and a tread, the combination of a rigid mounting support structure extending along each tread adjacent the forward portion thereof and a plurality of seating modules adjacent each other in a lineal seating arrangement, each module having an upper seating panel for supporting a person sitting thereon above the tread of one tier and toward the front such that the feet of the person rest on the tread of the tier below, a front panel extending downward from said seating panel to a location beneath the level of the tread surface of the tier on which the module is mounted, a rear panel extending downward from said upper seating panel and forwardly to provide foot space, and a base extending between the lower portions of said front and rear panels, at least said front panel, rear panel and base being integrally formed of structural foamed plastic, and mounting means coupled to said base for fixedly mounting said seat module on said rigid support member, one end of each module defining an integrally formed interlocking extension dimensioned to be snugly received immediately behind at least the front panel of an adjacent module when said modules are assembled together and to said rigid support member.

* * * * *